US008286346B2

(12) United States Patent
Furuya et al.

(10) Patent No.: US 8,286,346 B2
(45) Date of Patent: Oct. 16, 2012

(54) METHOD FOR INSERTING A TERMINAL

(75) Inventors: Hiroshi Furuya, Makinohara (JP); Kazuhiko Sugimura, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/279,662

(22) Filed: Oct. 24, 2011

(65) Prior Publication Data

US 2012/0036713 A1 Feb. 16, 2012

Related U.S. Application Data

(63) Continuation of application No. 12/219,705, filed on Jul. 28, 2008, now Pat. No. 8,065,791.

(30) Foreign Application Priority Data

Sep. 7, 2007 (JP) ..... 2007-232927

(51) Int. Cl.
*H01R 43/20* (2006.01)

(52) U.S. Cl. ..... 29/857; 29/33 M; 29/754

(58) Field of Classification Search ..... 29/748, 29/754.33 M, 857
See application file for complete search history.

(56) References Cited

U.S. PATENT DOCUMENTS 7,441,327 B2 * 10/2008 Furuya et al. ..... 29/748
7,650,689 B2 * 1/2010 Furuya et al. ..... 29/749

FOREIGN PATENT DOCUMENTS

JP 2006-092841 4/2006

* cited by examiner

*Primary Examiner* — Livius R Cazan
(74) *Attorney, Agent, or Firm* — Edwards Wildman Palmer LLP

(57) ABSTRACT

The present invention is to provide a terminal insertion apparatus and method to insert a terminal into a terminal-receiving chamber without hitting an inner surface of the terminal-receiving chamber. A terminal insertion apparatus includes a housing holder unit, an insertion unit, and a control device. The housing holder unit holds a connector housing and is movable in a horizontal direction and a vertical direction. The insertion unit inserts a terminal attached with an electrical wire into a terminal-receiving chamber of the connector housing. The control device controls a move unit support portion to reciprocate a housing holder by a move distance after an end portion of the terminal is inserted into the terminal-receiving chamber so that the terminal can be inserted without hitting an inner surface of the terminal-receiving chamber.

5 Claims, 8 Drawing Sheets

| NUMBER OF TERMINAL RECEIVING CHAMBER | HORIZONTAL MOVE DISTANCE | VERTICAL MOVE DISTANCE |
|---|---|---|
| ① | 1Amm | 1Bmm |
| ② | 2Amm | 2Bmm |
| ③ | 3Amm | 3Bmm |
| ④ | 4Amm | 4Bmm |
| ⑤ | 5Amm | 5Bmm |
| ⑥ | 6Amm | 6Bmm |
| ⑦ | 7Amm | 7Bmm |
| ⑧ | 8Amm | 8Bmm |
| ⑨ | 9Amm | 9Bmm |
| ⑩ | 10Amm | 10Bmm |

METHOD FOR INSERTING A TERMINAL

CROSS REFERENCE TO RELATED APPLICATIONS

This application filed on Oct. 24, 2011 having Ser. No. 13/279,662 is a continuation of U.S. patent application Ser. No. 12/219,705, filed Jul. 28, 2008 now U.S. Pat. No. 8,065,791, which application claims priority to Japanese Pat. App. No. 2007-232927, filed Sep. 7, 2007, which application is incorporated herein by reference.

BACKGROUND OF THE INVENTION

1. Field of the Invention

The present invention relates to a method for inserting a terminal connected with an electrical wire into a terminal-receiving chamber of a connector housing.

2. Description of the Related Art

A variety of terminal insertion apparatus (for example, JP 2006-92841 A) has been utilized to insert a terminal 103 connected with an electrical wire 102 into a terminal-receiving chamber 101 of a connector housing 100 to be assembled into a wiring harness of a motor vehicle.

The terminal insertion apparatus includes a main body, a housing holder, a wire holder, and an insertion head. The main body is installed on a floor of a factory and the housing holder is attached to the main body to hold the connector housing 100. The wire holder holds the electrical wire 102 attached with the terminal 103. The insertion head removes the electrical wire 102 from the wire holder and inserts the terminal 103 into the terminal-receiving chamber 101.

The conventional terminal insertion apparatus inserts the terminal 103 in a longitudinal direction of the terminal-receiving chamber 101. This insertion causes the terminal 103 to hit a projection 101*a* disposed on an inner surface of the terminal-receiving chamber 101 as shown in FIG. 8. In the conventional apparatus further insertion of the terminal 103 can occur even if the terminal 103 hits the projection 101*a*. The further insertion inclines the terminal 103 and fails to move the terminal 103 as shown in FIG. 9. In the worst case, the insertion head bends the electrical wire 102 or deforms the terminal 103, resulting in a defective product.

SUMMARY OF THE INVENTION

An object of the present invention is to provide a method for assuredly inserting a terminal into a terminal-receiving chamber without hitting an inner surface of the terminal-receiving chamber with the terminal.

According to a first aspect of the present invention, there is provided a method for inserting a terminal connected to an electrical wire into a terminal-receiving chamber of a connector housing. The method comprises the steps of: (a) holding the connector housing by a housing holder, the housing holder being movably supported by a move unit support portion; (b) holding the terminal by an insertion unit; and (c) controlling, by a control unit, the housing holder and the insertion unit and making the insertion unit insert the terminal into the terminal-receiving chamber held by the housing holder. In the insertion operation, the control device is configured to control the move unit support portion to make the housing holder reciprocate by a predetermined amplitude such that the terminal is prevented from hitting an inner surface of the terminal-receiving chamber in insertion of the terminal into the terminal-receiving chamber.

Preferably, the control device keeps the move unit support portion in a halt state until an end portion of the terminal is inserted into the terminal-receiving chamber with the insertion unit, and reciprocates the housing holder with the move unit support portion after the end portion of the terminal is inserted into the terminal-receiving chamber with the insertion unit.

Preferably, the control device controls the move unit support portion to reciprocate the housing holder in two directions, which are orthogonal to one another, intersecting an insertion direction of the terminal.

Preferably, the control device stores a predetermined move distance of the terminal in the terminal-receiving chamber of the connector housing having an associated part number, the control device controlling the move unit support portion to reciprocate the housing holder by the predetermined move distance.

Preferably, the terminal insertion method utilizes an input device for inputting an information of a part number of the connector housing held with the housing holder, the control device controlling the move unit support portion to reciprocate the housing holder by the predetermined distance corresponding to the part number of the connector housing input with the input device after an end portion of the terminal is inserted into the terminal-receiving chamber with the terminal insertion apparatus.

According to the present invention, the control device reciprocates the connector housing when the terminal is inserted into the terminal-receiving chamber so that the reciprocating movement of the connector housing prevents the terminal from hitting the inner surface of the terminal-receiving chamber.

According to the present invention, the control device reciprocates the connector housing after the end portion of the terminal is inserted into the terminal-receiving chamber to achieve an assured insertion of the terminal.

According to the present invention, the control device reciprocates the connector housing in the two directions, which are orthogonal to one another, intersecting the insertion direction in order to prevent the terminal from hitting the inner surface of the terminal-receiving chamber and achieve the assured insertion of the terminal.

According to the present invention, the control device stores the move distance of the terminal in the terminal-receiving chamber of the connector housing having the respective part numbers so that the terminal can be quickly escaped from the inner surface of the terminal-receiving chamber when the terminal hits the inner surface in order to achieve the assured insertion.

According to the present invention, the terminal insertion method utilizes the input device to input the part number of the connector housing, the move distance to reciprocate the connector housing corresponding to the part number prevents the terminal from hitting the inner surface of the terminal-receiving chamber.

DETAILED DESCRIPTION OF THE PREFERRED EMBODIMENTS

Figure 1:
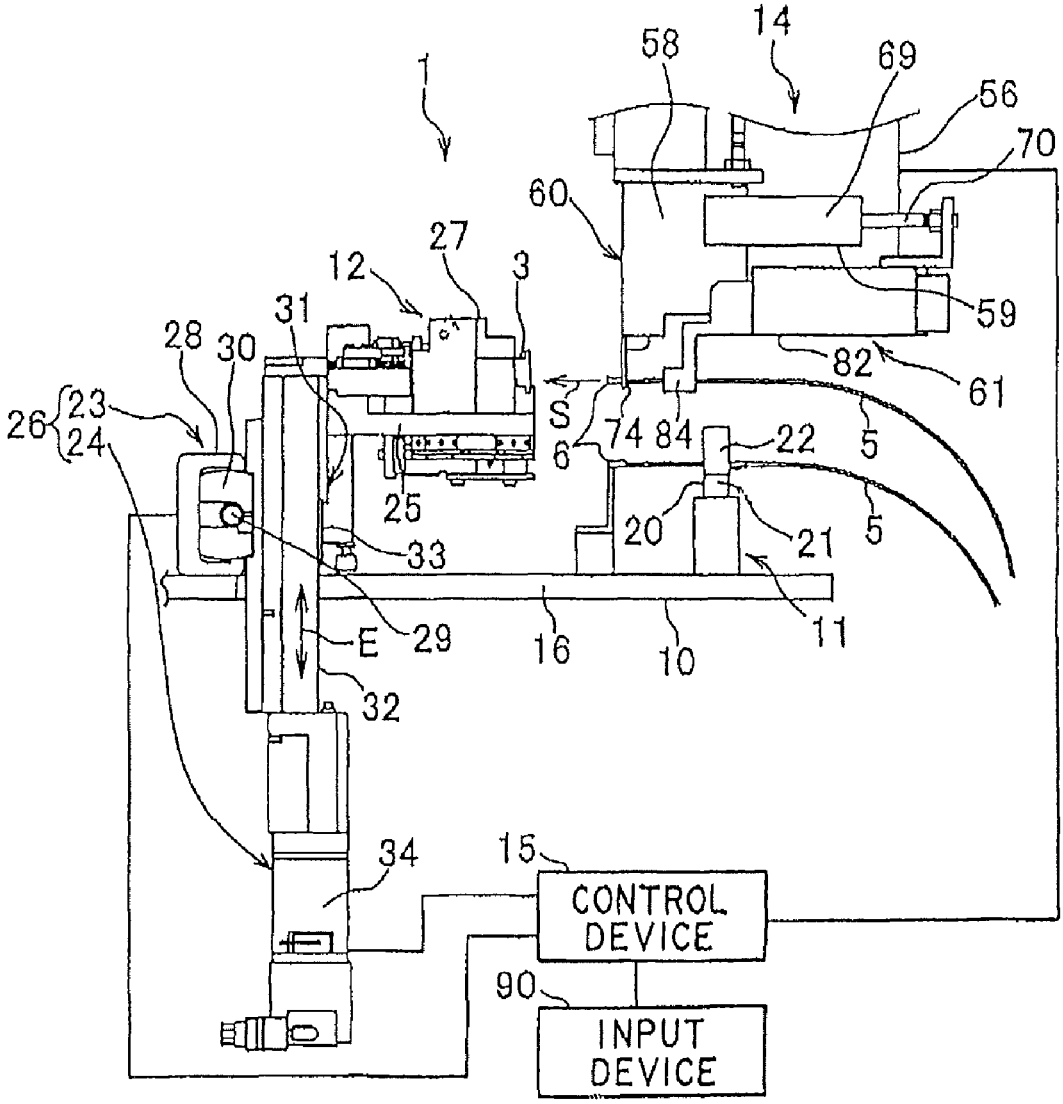
FIG. 1 is a side view of an embodiment of a terminal insertion apparatus of the present invention.
Figure 2:
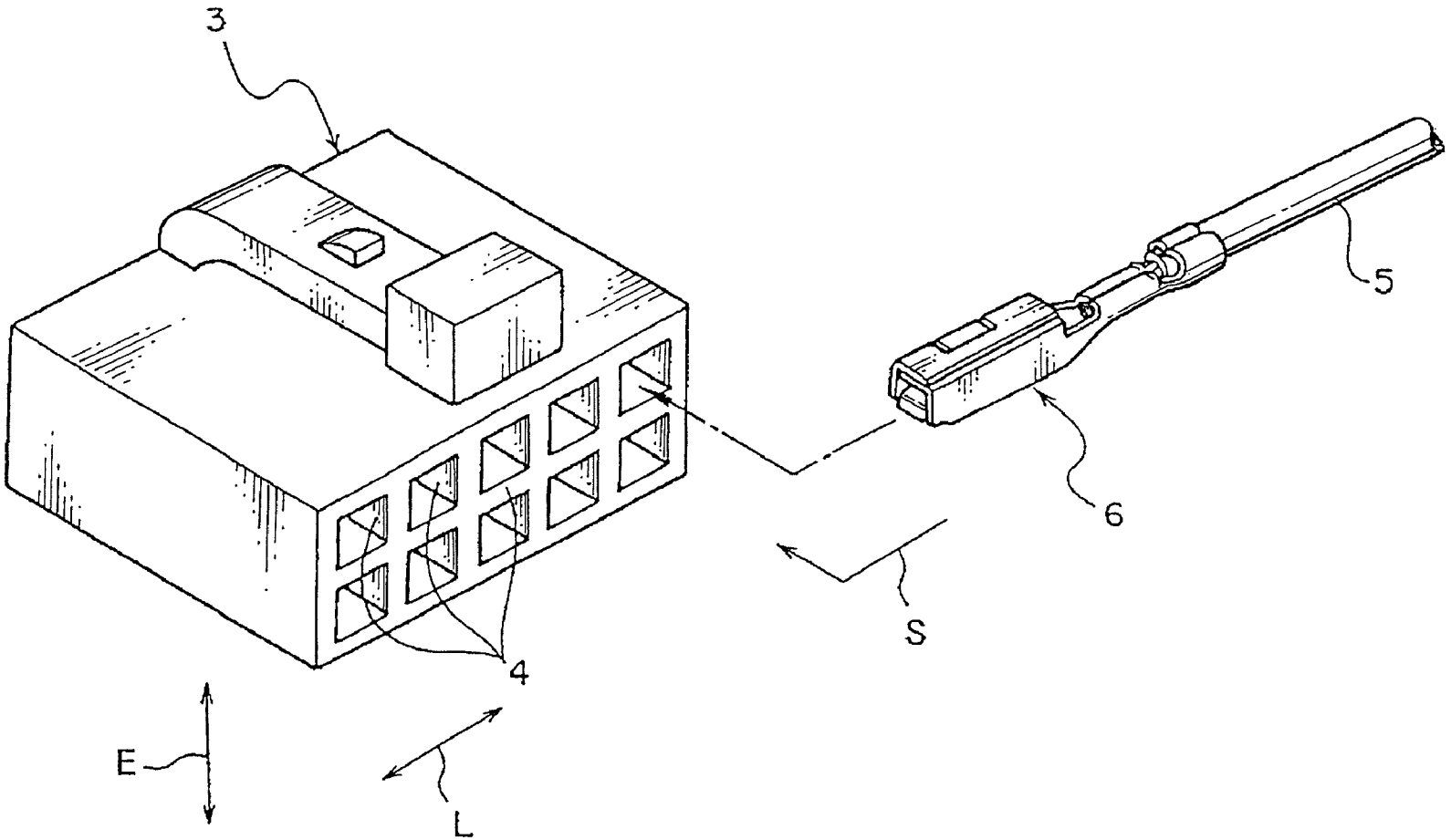
FIG. 2 is a perspective view of a connector housing to be inserted with a terminal by means of the terminal insertion apparatus of FIG. 1.
Figures 3A, 3B:
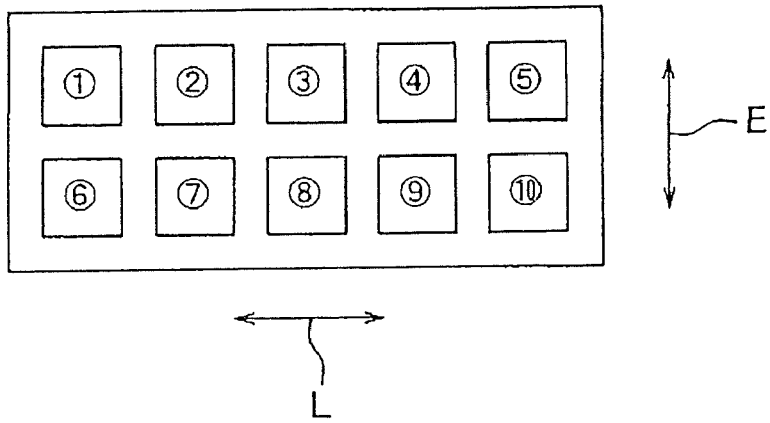
FIG. 3A shows positions of a plurality of terminal-receiving chambers of the connector housing.
FIG. 3B shows a horizontal move distance and a vertical move distance in the respective terminal-receiving chambers.

An embodiment of a terminal insertion apparatus of the present invention is illustrated in FIGS. 1-6. A terminal insertion apparatus 1 of FIG. 1 inserts a terminal 6 connected with an electrical wire 5 into an associated terminal-receiving chamber 4 of a connector housing 3, shown in FIG. 2, with a variety of part numbers.

The connector housing 3, which is made of an insulation synthetic resin and formed in a rectangular shape, includes the plurality of the terminal-receiving chambers 4 passing through the connector housing 3. The terminal-receiving chambers 4 each receive the associated terminal 6 connected with an electrical wire 5 having a conductive core and an insulation sheath.

A connector having the connector housing 3 is fitted to a mating connector to configure a wiring harness in a motor vehicle. Either of the terminal-receiving chambers 4 or the terminals 6 have locking arms to be locked together so as to hold the terminals 6. The terminal-receiving chambers 4 each have a variety of projections as well as the locking arm on an inner surface thereof. Size of the connector housing 3 and the positions of the terminal-receiving chambers 4 vary according to the part numbers.

Referring to FIG. 1, the terminal insertion apparatus 1 includes a main body 10, a wire holder unit 11, a housing holder unit 12, an insertion unit 14, and a control device (control means) 15.

The main body 10 is installed on a floor of a factory and has a flat table 16.

As shown in FIG. 1, the wire holder unit 11 is disposed on the main body 10 and has a rod 2.

The rod 20 includes a rod main body 21 and a pinch member 22. The rod main body 21 extends in a direction perpendicular to the drawing of FIG. 1 and is detachable from the wire holder unit 11.

A plurality of the pinch members 22 are disposed in a longitudinal direction of the rod main body 21 and each pinch member 22 is urged to pinch the electrical wire 5 therebetween.

The pinch members 22 each pinch the electrical wire 5 attached to the terminal 6 prior to insertion of the terminal 6. The pinch members 22 of the wire holder unit 11 each also hold the connector housing 3 inserted with the terminals 6 attached with the electrical wires 5.

The housing holder unit 12 includes a move unit support portion 26, a support table 25, and a housing holder 27. The move unit support portion 26 has a horizontal move unit 23 and a vertical move unit 24.

The horizontal move unit 23 includes a motor (not shown) attached to the main body 10, and a ball screw 28 having a screw axle 29 and a nut 30. The screw axle 29 extends in a direction perpendicular to the drawing and is driven with the motor and rotatably supported with the main body 10.

The nut 30 is screwed together with the screw axle 29 and is attached with the vertical move unit 24, or the housing holder 27. The horizontal move unit 23 moves the nut 30, or the housing holder 27 in the longitudinal direction of the screw axle 29 (direction L depicted in FIG. 2).

The vertical move unit 24 has a motor 34 attached to the nut 30, and a ball screw 31 having a screw axle 32 and a nut 33. The screw axle 32 is vertically rotatably supported with the nut 30 and is driven by the motor 34. The nut 33 is screwed together with the screw axle 32 and attached with the support table 25, or the housing holder 27. The vertical move unit 24 is driven with the motor 34 so as to move the nut 33, or the housing holder 25 in the longitudinal direction of the screw axle 32 (direction E depicted in FIG. 2).

The move unit support portion 26 moves the housing holder 27, or the connector housing 3 supported with the housing holder 27, by means of the horizontal move unit 23 and the vertical move unit 24 in a horizontal direction L, perpendicular to the drawing of FIG. 1, and the vertical direction E, respectively. Two directions L and E intersect a direction S of movement of the insertion unit 14.

The support table 25 is attached to the nut 33 of the vertical move unit 24 and extends toward the wire holder unit 11.

The housing holder 27 is attached to the support table 25 and holds the connector housing 3. The housing holder 27 varies the shape according to the part number of the connector housing 3.

The housing holder unit 12 is positioned above the table 16 when the terminal 6 is inserted into the connector housing 3 so that the longitudinal direction of the terminal-receiving chambers 4 intersects the horizontal direction L and the vertical direction E.

When the insertion of the terminals 6 is completed, the vertical move unit 24 lowers the housing holder 27 while a wire chuck unit 61 holds the lastly inserted terminal 6 connected with the electrical wire 5. The housing holder unit 12 then releases the connector housing 3 from the housing holder 27.

Referring to FIG. 1, the insertion unit 14 includes a stationary portion (not shown), a move unit (not shown), a horizontal move plate 56, a lift cylinder (not shown), a lift plate 58, an insertion cylinder 59, a front chuck unit 60, and the wire chuck unit 61.

The stationary portion is disposed on a main frame of the main body 10 and attached with the move unit to move the horizontal move plate 56 or the front chuck unit 60, and the wire chuck unit 61 in the insertion direction S and the vertical direction E.

The horizontal move plate 56 is disposed spaced apart from the housing holder 27 in the insertion direction S and is moved in the directions S and E with the move unit.

The lift cylinder includes a cylinder main body attached to the horizontal move plate 56 and a retractable rod in the cylinder main body to lift the lift plate 58.

The lift plate 58 is vertically movably supported with the horizontal move plate 56.

The insertion cylinder 59 includes a cylinder main body 69, and a rod 70 attached with the wire chuck unit 61 and extensible in the cylinder main body 69. The wire chuck unit 61 approaches to and separates from the housing holder unit 12 with contraction and extension of the rod 70 of the insertion cylinder 59.

The front chuck unit 60 includes a chuck cylinder (not shown) and a pair of front chucks 74.

The chuck cylinder includes a cylinder main body attached to the lift plate 58, and a pair of rods projecting from the cylinder main body. The rods are disposed spaced apart from one another in a direction perpendicular to the drawing of FIG. 1.

The rods are separable from one another and attached with the front chucks 74 which pinch the electrical wire 5 therebetween when they are approached together.

The wire chuck unit 61 includes a chuck support plate 82, a chuck cylinder (not shown), and a pair of wire chucks 84.

The chuck support plate 82 is attached to the rod 70 of the insertion cylinder 59 and can approach to and separate from the housing holder unit 12 in the insertion direction S of the terminal 6 in response to extension and contraction of the rod 70.

The chuck cylinder includes a cylinder main body attached to the chuck support plate 82 and a pair of rods (not shown) projecting from the cylinder main body toward the housing holder unit 12. The pair of the rods are disposed spaced apart one another in the direction perpendicular to the drawing of FIG. 1. The pair of the wire chucks 84 are attached to the pair of rods to pinch the electrical wire 5 attached to the terminal 6.

The insertion unit 14 lowers the horizontal move plate 56 or the front chuck unit 60, and the wire chuck unit 61 with the move unit, and separates the pair of the rods of the chuck cylinder of the front chuck unit 60 from one another to pinch a portion of the electrical wire 5 separated from the terminal 6 by about 3 mm.

The insertion unit 14 upwardly moves the horizontal move plate 56 to pull out the electrical wire 5 from the wire holder unit 11.

The insertion unit 14 brings the horizontal move plate 56 close to the housing holder 27 with the move unit and inserts the terminal 6 into the terminal-receiving chamber 4 while keeping the terminal 6 and the terminal-receiving chamber 4 parallel to each other.

The insertion unit 14 separates the pair of the front chucks 74 one another, and moves or lifts the lift plate 58 or the front chucks 74 from the electrical wire 5. The insertion unit 14 approaches the wire chuck unit 61 toward the housing holder 27 and inserts the terminal 6 into the terminal-receiving chamber 4 along the insertion direction S.

When the locking arm is locked, the terminal 6 is fixed to the terminal-receiving chamber 4. The insertion unit 14 then separates the wire chucks 84 from one another and removes the wire chucks unit 61 from the electrical wire 5. The insertion unit 14 detaches the next electrical wire 5 from the rod 20 and inserts the terminal 6 attached with the electrical wire 5 into the terminal-receiving chamber 4.

When the insertion of the terminals 6 is completed, the wire chuck unit 61 of the insertion unit 14 remains to hold the electrical wire 5 inserted at the last. The housing holder 27 is lowered with the vertical move unit 24 and the connector housing 3 is then released from the housing holder 27.

The insertion unit 14 is moved with the insertion cylinder 59 and the move units toward the pinch member 22 of the wire holder unit 11 and places the electrical wire between the pinch member 22.

The control device 15 is a computer including a RAM, ROM and CPU and connected to the move unit support portion 26 of the housing holder unit 12 and the insertion unit 14 to control the terminal insertion apparatus 1.

The control device 15 stores an insertion order of the terminals 6 to the terminal-receiving chamber 4 with the different part numbers, a position of the rod 20 holding the respective terminals 6 to be inserted into the associated terminal-receiving chamber 4, and a position of the associated terminal-receiving chamber 4. The control device 15 stores a plurality of horizontal and vertical move distances 1A-10A and 1B-10B (see FIG. 3A) for the connector housing 3 with the respective part numbers so that the move unit support portion 26 reciprocates the housing holder 27 or the connector housing 3 by the respective distances 1A-10A and 1B-10B in the directions L and E (see FIG. 3A) so as not to hit the projections inside of the terminal-receiving chamber 4 after the terminals 6 are inserted into the terminal-receiving chamber 4. The horizontal and vertical move distances 1A-10A and 1B-10B are predetermined and vary with the respective terminal-receiving chambers 4 of the connector housing 3 with the respective part numbers to prevent the terminals 6 from hitting the inner surface of the terminal-receiving chamber 4.

The control device 15 reciprocates the housing holder 27 by means of the move unit support portion 26 in the directions L and E by the horizontal and vertical move distances 1A-10A and 1B-10B with a predetermined frequency in order to complete insertion of each of the terminals 6 into the associated terminal-receiving chambers 4 having a part number input by a input device 90 described below.

The control device 15 sets the move unit support portion 26 in a halt state prior to insertion of each terminal into the associated terminal-receiving chamber 4. When end portions of the terminals 6 each are inserted into the respective terminal-receiving chambers 4, the control device 15 reciprocates the housing holder 27 by means of the move unit support portion 26 in the directions L and E by the predetermined move distances 1A-10A and 1B-10B to prevent the each terminal 6 from hitting the inside surface of the terminal-receiving chamber 4 and complete insertion of the terminal 6. The housing holder 27 is reciprocated with the move unit support holder portion 26 by the respective move distances 1A-10A and 1B-10B and the move distances are thus referred to amplitudes.

The control device 15 stores the set position of the electrical wire 5, which is attached with the terminal 6 lastly inserted, to the pinch member 22 and also other information about insertion of the terminals 6. The control device 15 is connected to the input device 90 having a keyboard and a switch. The input device 90 inputs the information about the part number of the connector housing 3 to the control device 15.

The terminal insertion apparatus 1 inserts the terminals 6 into the terminal-receiving chambers 4 of the connector housing 3 with the following steps. The input device 90 inputs the control device 15 the information about the part number of the connector 2 to be assembled. The housing holder 27 corresponding to the part number of the connector 2 is attached to the support table 25 of the housing holder unit 12. The rod 20 corresponding to the part number is set to the wire holder unit 11.

The input device 90 provides an order of starting work to the control device 15. The vertical move unit 24 upwardly moves the housing holder 27.

The rod of the lift cylinder of the insertion unit 14 is contracted to extend the rod 70 of the insertion cylinder 59. The pair of the rods of the front chuck unit 60 of the insertion unit 14 are separated from one another and the pair of the rods of the wire chuck unit 61 are also separated from one another.

The control device 15 moves the terminal-receiving chamber 4 with the horizontal move unit 23 to face the chuck units 60 and 61 of the insertion unit 14 along the direction S to receive the first terminal 6. The control device 15 moves the front chuck unit 60 above the terminal 6 and moves the wire chuck unit 61 above the electrical wire 5.

The control device 15 moves the front chuck unit 60 and the wire chuck unit 61 toward the electrical wire 5 held with the wire holder unit 11 with the move unit of the insertion unit 14.

The control device 15 controls the front chuck 74 and the wire chuck 84 to hold the terminal 6 and the electrical wire 5, respectively.

Figure 4:
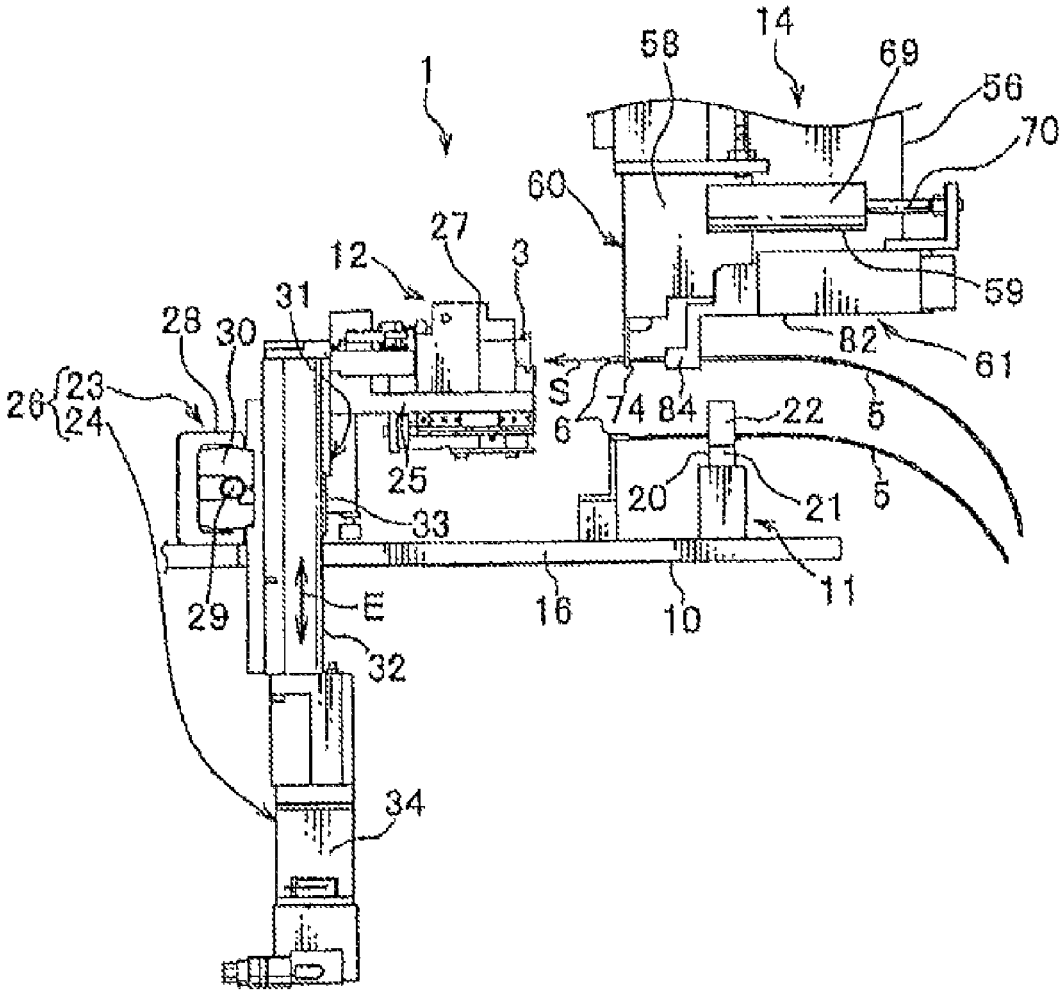
FIG. 4 is a side view showing that the terminal insertion apparatus removes the terminal attached with an electrical wire from a rod.

The control device 15 moves upwardly the chuck units 60 and 61 from the wire holder unit 11 so that the terminal 6 faces the terminal-receiving chamber 4 held with the housing holder 27 as shown in FIG. 4.

Figure 5:
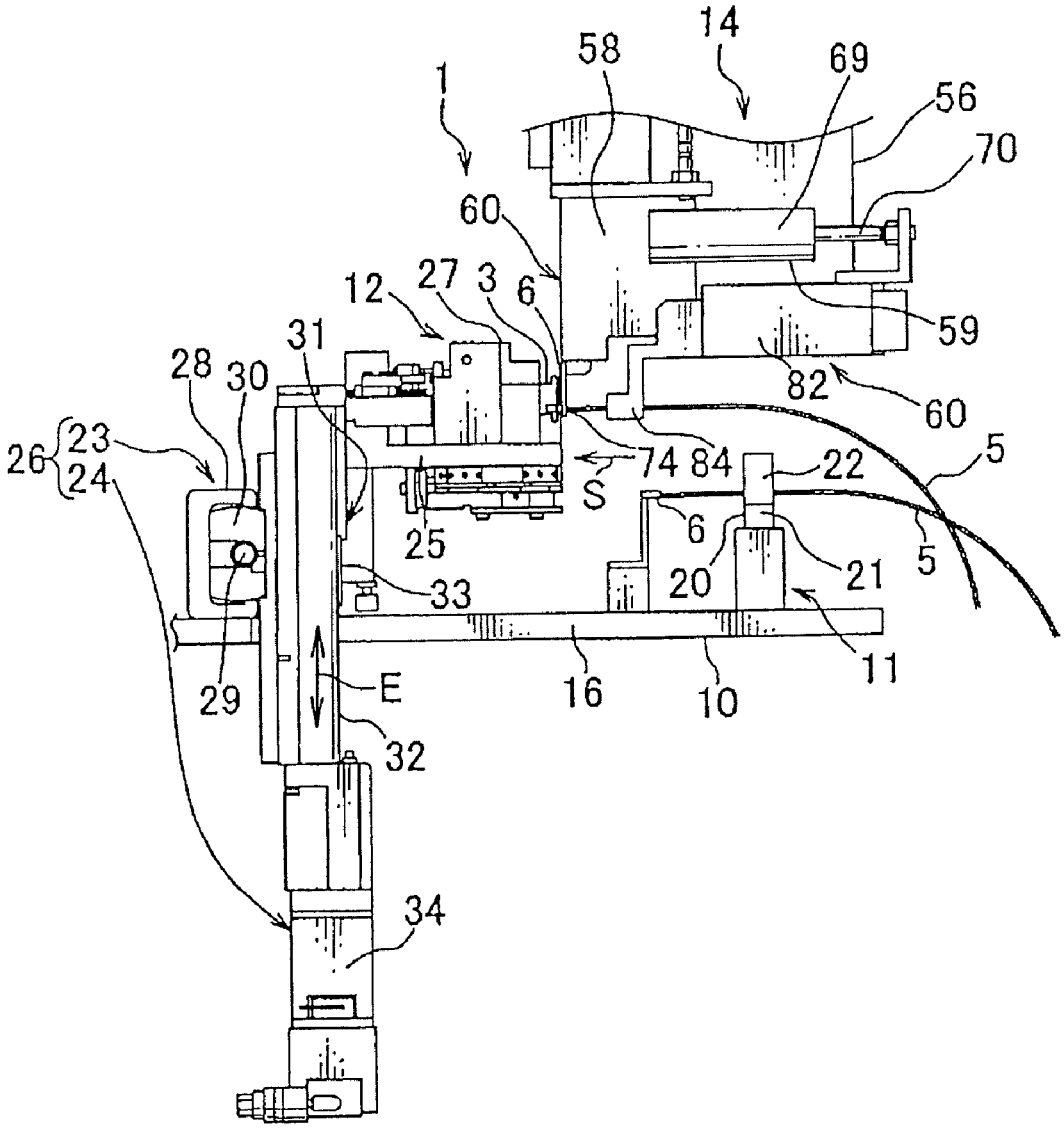
FIG. 5 is a side view showing that the terminal insertion apparatus inserts an end portion of the terminal into the associated terminal-receiving chamber, which follows from FIG. 4.
Figure 6:
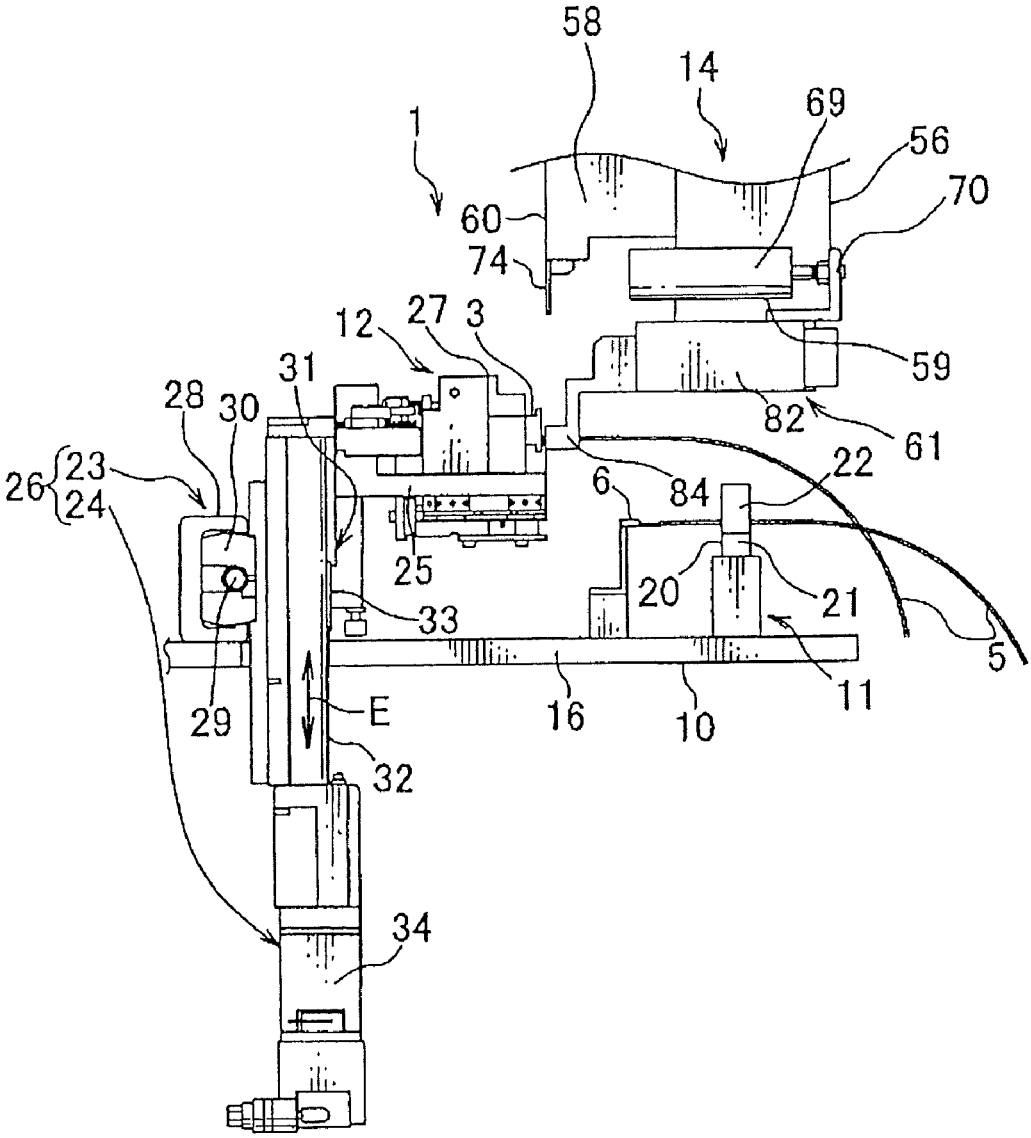
FIG. 6 is a side view showing that the terminal is completely inserted into the terminal-receiving chamber, which follows from FIG. 5.
Figure 7:
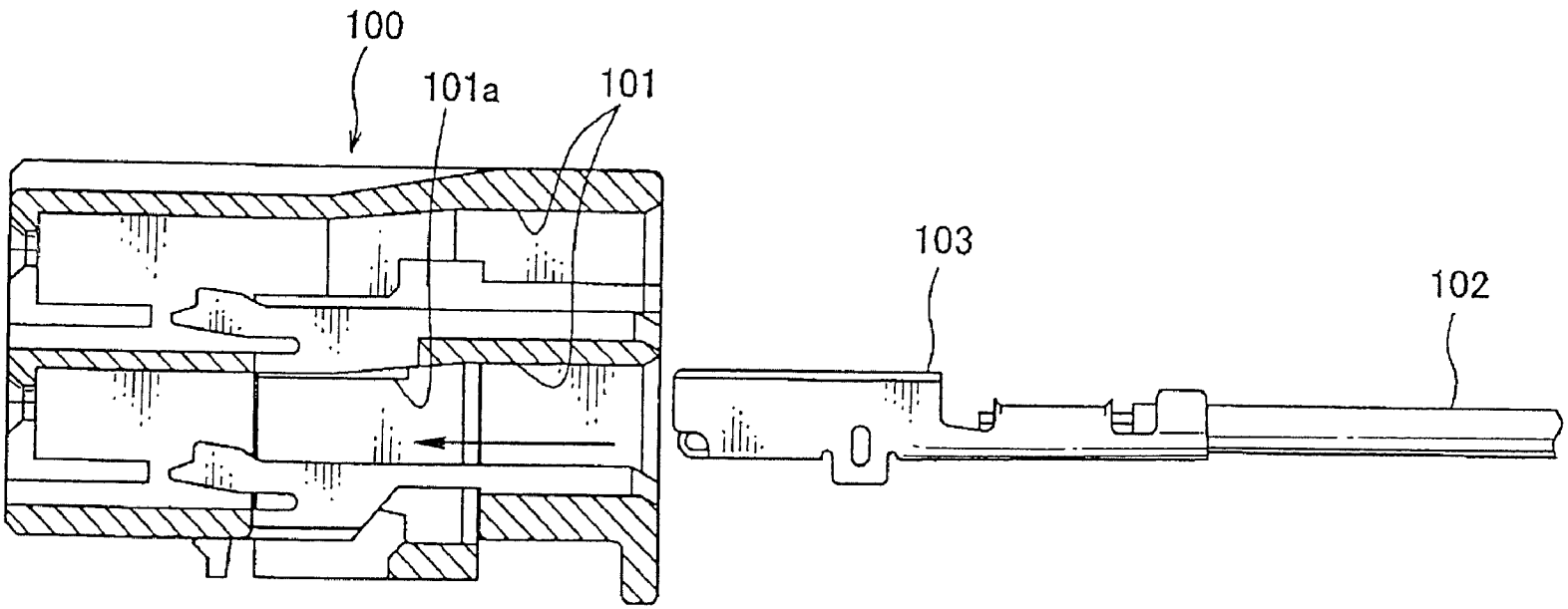
FIG. 7 PRIOR ART
FIG. 7 is a sectional view of a conventional connector housing and a conventional terminal.
Figure 8:
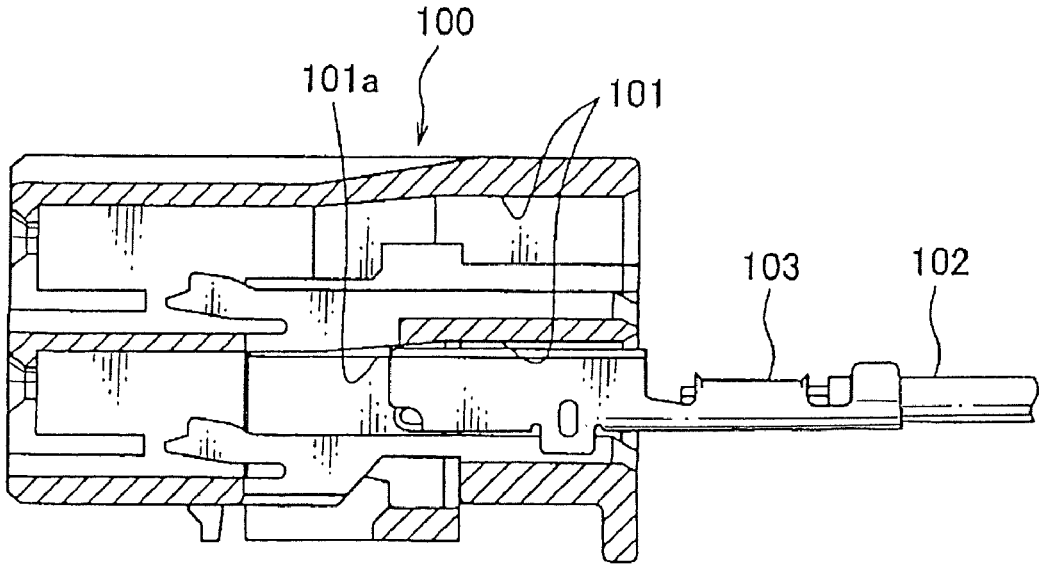
FIG. 8 PRIOR ART
FIG. 8 is a sectional view showing that the terminal hits an inner surface of the terminal-receiving chamber of the connector housing.
Figure 9:
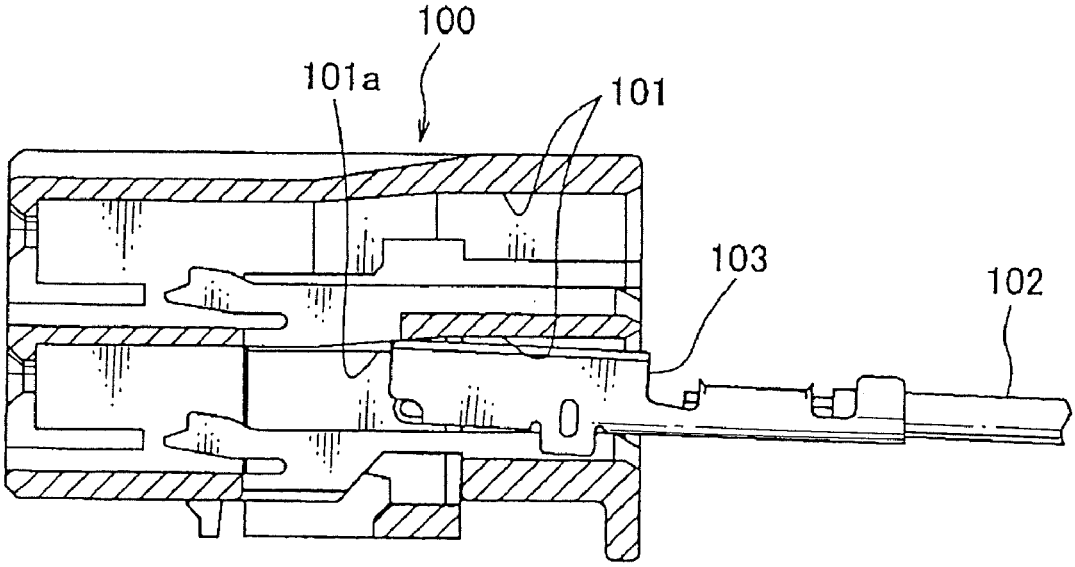
FIG. 9 PRIOR ART
FIG. 9 is a sectional view showing that the terminal of FIG. 8 is inclined in the terminal-receiving chamber.

The control device 15 inserts an end portion of the terminal 6 into the terminal-receiving chamber 4 with control of the move unit as shown in FIG. 5. The control device 15 controls the chuck cylinder of the front chuck unit 60 to release the terminal 6 and moves upwardly the front chuck 70 away from the terminal 6. The control device 15 keeps the move unit support portion 26 in the halt state until the end portion of the terminal 6 is inserted into the terminal-receiving chamber 4.

After the end portion of the terminal 6 is inserted into the terminal-receiving chamber 4, the control device 15 reads out the horizontal and vertical move distances 1A-10A and 1B-10B of the associated terminal-receiving chamber 4 corresponding to the part number of the connector housing 3 held with the housing holder 27. The control device 15 controls the move unit support portion 26 to reciprocate the housing holder 27 or the connector housing 3 by the associated move distances 1A-10A and 1B-10B. While the move unit support portion 26 reciprocates the housing holder 27 by the move distances 1A-10A and 1B-10B, the control device 15 controls simultaneously the insertion cylinder 59 of the insertion unit 14 to insert the terminal 6 into the terminal-receiving chamber 3 in the direction S.

The control device 15 controls the wire chuck unit 61 to release the electrical wire 5 from the wire chuck 84. The control device 15 repeats the steps depicted in FIGS. 4-6 in order.

When the last terminal 6 is inserted into the associated terminal-receiving chamber 4, the control device 15 controls the vertical move unit 24 to lower the housing holder 27 while the wire chuck unit 61 holds the electrical wire 5 attached with the last terminal 6

The connector housing 3 is thus released from the housing holder 27. The control device 15 moves the wire chuck 84 pinching the electrical wire 5 above the pinch member 22. The control device 15 controls the move unit of the insertion unit 14 to lower the wire chuck 84 and put the electrical wire 5 attached to the connector housing 3 between the pinch member 84.

According to the present invention, the control device 15 reciprocates the connector housing 3 with the move unit support portion 26 when the terminal 6 is inserted into the associated terminal-receiving chamber 4 so that the hitting of the terminal 6 to the inner surface of the terminal-receiving chamber 4 can be quickly prevented with the reciprocal movement. The terminal 6 is thus assuredly inserted into the terminal-receiving chamber 4 without damage thereof.

The reciprocal movement is provided to the connector housing 3 after each end portion of the terminals 6 is inserted into the terminal-receiving chamber 4 so that the terminal 6 is assuredly inserted into the terminal-receiving chamber 4.

The reciprocal movements in the horizontal and vertical direction L and E intersecting the insertion direction S prevent quickly the terminal 6 from hitting the inner surface of the terminal-receiving chamber 4. The terminal 6 is thus assuredly inserted into the terminal-receiving chamber 4 without damage thereof.

The control device 15 stores the move distances 1A-10A and 1B-10B of the terminals 6 in the terminal-receiving chambers 4 of the connector housing 3 corresponding to the respective part numbers. The control device 15 controls the move unit support portion 26 to reciprocate the pertinent connector housing 3 so that the hitting of the terminal 6 to the inner surface of the terminal-receiving chamber 4 can be quickly prevented with the reciprocal movement. The terminal 6 is thus assuredly inserted into the terminal-receiving chamber 4.

The part numbers of the connector housings 3 are each input by the input device 90 to the control device 15 to achieve the assured insertion of the terminal 6 without hitting the inner surface of the terminal-receiving chamber 4. The terminal 6 is thus assuredly inserted into the terminal-receiving chamber 4.

In the embodiment, the terminal-receiving chambers 4 receive the terminals 6, but the terminals 6 are not necessary entirely inserted therein.

It is appreciated that the reciprocal movement of the housing holder 27 is not limited to the time when the end portions of the terminals are inserted into the terminal-receiving chamber 4. The reciprocal movement of the housing holder 27 can be carried out any time during insertion of the terminals 6.

It is appreciated that an oblique movement can be added to the horizontal movement L and the vertical movement E and that the terminals can be reciprocated by the move distances 1A-10A and 1B-10B.

The embodiment of the present invention is only exemplary and not limited thereto. Any modification and alteration is within scope of spirit of the present invention.

What is claimed is:

1. A method for inserting a terminal connected to an electrical wire into a terminal-receiving chamber of a connector housing, the method comprising the steps of:

(a) holding the connector housing by a housing holder, said housing holder being movably supported by a move unit support portion;

(b) holding the terminal by an insertion unit;

(c) controlling by a control device said housing holder and said insertion unit and making said insertion unit insert the terminal into the terminal-receiving chamber held by said housing holder, wherein said control device controls said move unit support portion to make the housing holder reciprocate by a predetermined amplitude such that the terminal is prevented from hitting an inner surface of the terminal-receiving chamber in insertion of the terminal into the terminal-receiving chamber.

2. The method as claimed in claim 1, further comprising storing a predetermined move distance of the terminal in the terminal-receiving chamber of the connector housing having an associated part number in said control device, and controlling the move unit support portion with said control device such that the move unit support portion makes the housing holder reciprocate by the predetermined move distance.

3. The method as claimed in claim 2, further comprising inputting information of a part number of the connector housing held by the housing holder into said control device via an input device, and controlling the move unit support portion with the control device such that the move unit support portion makes the housing holder reciprocate by the predetermined distance corresponding to the part number of the connector housing input by the input device after an end portion of the terminal is inserted into the terminal-receiving chamber.

4. The method as claimed in claim 1, further comprising controlling the move unit support portion with the control device in a halt state until an end portion of the terminal is inserted into the terminal-receiving chamber by the insertion unit, and controlling the move unit support portion with the control device such that the move unit support portion makes the housing holder reciprocate after the end portion of the terminal is inserted into the terminal-receiving chamber by the insertion unit.

5. The method as claimed in claim 1, further comprising controlling the move unit support portion with the control device so as to make the housing holder reciprocate in two directions orthogonal to each other and intersecting in an insertion direction of the terminal.

* * * * *